US009714559B2

(12) United States Patent
Ring et al.

(10) Patent No.: US 9,714,559 B2
(45) Date of Patent: Jul. 25, 2017

(54) METHOD AND APPARATUS FOR HYDRAULIC FRACTURING

(71) Applicant: Weatherford Technology Holdings, LLC, Houston, TX (US)

(72) Inventors: Lev Ring, Bellaire, TX (US); Cesar G. Garcia, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 363 days.

(21) Appl. No.: 14/076,935

(22) Filed: Nov. 11, 2013

(65) Prior Publication Data

US 2015/0129229 A1 May 14, 2015

(51) Int. Cl.

| | |
|---|---|
| ***E21B 43/26*** | (2006.01) |
| ***E21B 23/08*** | (2006.01) |
| ***E21B 34/14*** | (2006.01) |
| *E21B 34/00* | (2006.01) |

(52) U.S. Cl.

CPC ..... *E21B 43/26* (2013.01); *E21B 23/08* (2013.01); *E21B 34/14* (2013.01); *E21B 2034/007* (2013.01)

(58) Field of Classification Search

CPC ..... E21B 34/14; E21B 34/007; E21B 23/08; E21B 23/10; E21B 43/26; E21B 2034/007

See application file for complete search history.

(56) References Cited

U.S. PATENT DOCUMENTS

| | | | | |
|---|---|---|---|---|
| 2,999,545 | A * | 9/1961 | Bigelow | E21B 34/14 166/153 |
| 5,413,173 | A | 5/1995 | Mills et al. | |
| 7,387,165 | B2 | 6/2008 | Lopez de Cardenas et al. | |
| 2006/0124310 | A1 * | 6/2006 | Lopez de Cardenas | E21B 34/06 166/313 |
| 2007/0119597 | A1 | 5/2007 | McHardy et al. | |
| 2007/0137291 | A1 | 6/2007 | Green et al. | |
| 2007/0272411 | A1 | 11/2007 | Lopez de Cardenas et al. | |
| 2010/0108323 | A1 | 5/2010 | Wilkin | |
| 2011/0127047 | A1 * | 6/2011 | Themig | E21B 34/063 166/386 |
| 2013/0168090 | A1 * | 7/2013 | Themig | E21B 34/14 166/285 |

OTHER PUBLICATIONS

Canadian Office Action dated Dec. 21, 2015 for Canadian Patent Application No. 2,869,066.

* cited by examiner

*Primary Examiner* — Brad Harcourt

(74) *Attorney, Agent, or Firm* — Patterson & Sheridan, LLP

(57) ABSTRACT

A downhole tool for treating a zone adjacent a wellbore, comprising a body having at least two separable portions, the portions operable to open and close a fluid path through the tool, and at least one manipulator, like a spring-loaded finger, to establish a fluid path between an interior and exterior of the wellbore, thereby permitting a zone adjacent the wellbore to be treated. In another embodiment a method is disclosed for treating a zone of interest adjacent a wellbore.

24 Claims, 6 Drawing Sheets

METHOD AND APPARATUS FOR HYDRAULIC FRACTURING

BACKGROUND OF THE INVENTION

Field of the Invention

The present invention relates to treating zones adjacent a wellbore. More particularly, the invention relates to hydraulically fracturing multiple zones in a single trip.

Description of the Related Art

With extended reach wells, it is common to have multiple hydrocarbon-bearing zones at different locations along the length of a wellbore. In order to increase production at the various zones, they are often "hydraulically fractured." Hydraulic fracturing is a technique in which a liquid, like water is mixed with sand and chemicals and injected at high pressure into a hydrocarbon-bearing formation (zone) surrounding the wellbore. The resulting small fractures (typically less than 1 mm) permit oil and gas to migrate to the wellbore for collection. Multiple zones at different depths mean multiple fracturing jobs requiring each zone to be isolated from adjacent zones, typically through the use of packers that seal an annular area between the wellbore and a tubular string extending back to the surface of the well.

In some instances, the zones are fractured in separate trips using bridge plugs, resulting in multiple trips and increased costs. In other cases, the zones are treated using ball seats and balls of various sizes, resulting in wellbore debris when the balls are "blown out" to reach a lower zone. What is needed is a more efficient apparatus and methods for treating multiple zones in a single trip.

SUMMARY OF THE INVENTION

The present invention generally includes a downhole tool for treating a zone adjacent a wellbore, comprising a body having at least two separable portions, the portions operable to open and close a fluid path through the tool, and at least one manipulator, like a spring-loaded finger, to establish a fluid path between an interior and exterior of the wellbore, thereby permitting a zone adjacent the wellbore to be treated. In another embodiment a method is disclosed for treating a zone of interest adjacent a wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to multiple formation treatment jobs performed in a wellbore in a single trip.

Figure 1:
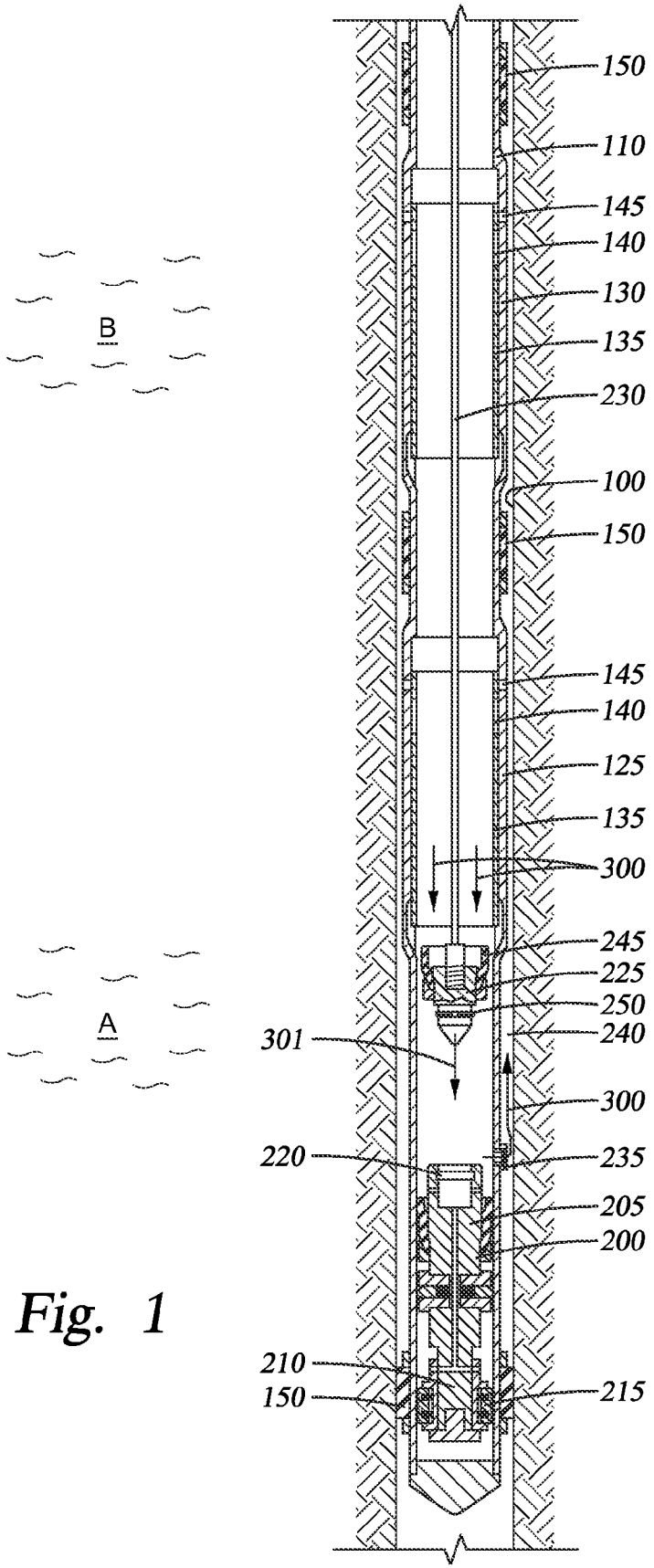
FIG. 1 is a section view of a tubular string disposed in a wellbore, with a fracturing tool and a latch assembly disposed in the string.

FIG. 1 is a section view of a wellbore 100 having a string of production tubing 110 installed therein. At a lower end of the string are two subs 125, 130 that are installed in the string 110. Each sub is placed in a location adjacent a zone of interest A, B and includes a slidable sleeve 135 having a window 140 formed therein and at least one port 145 permitting fluid communication between an inside and outside of the string 110 when the window 140 and the port 145 are aligned. In the embodiment of FIG. 1, each sub 125, 130 can be isolated from the other sub by packers 150. In FIG. 1, only the lowermost packer is shown in a set position, with the upper packers unset. Downhole settable packers are well known in the art and can be set remotely either with tools, movement, or in some cases by exposure to fluids. While only two subs 125, 130 are described in the present embodiment, it will be understood that the invention can be used with any number of subs and aspects of the invention are particularly useful when multiple zones (10-50) are being treated. Temporarily anchored at a lower end of the string is a fracturing tool 200 having an upper body 205, a lower body 210, an anchor assembly 215, and a latch recess 220. Shown in the wellbore above the tool and suspended on wireline 230 is a latch assembly 225, the operation of which will be explained in relation to the other figures.

Arrows 300 illustrate fluid flow and arrow 301 illustrates downward movement of the latch assembly. In FIG. 1, fluid is being circulated from the surface of the well, out a port 235, and upwards in an annulus 240 formed between the wellbore 100 and the tubing string 110. In one embodiment, the port 235 is initially blocked by a frangible member (not shown) and opened when pressure on a column of fluid in the wellbore is raised above a rupture threshold of the frangible member. Opening a port in a tubular string through pressure is well known and in the embodiment shown, the frangible member may have been previously ruptured prior to the installation of the wireline and latch assembly. One purpose of the flowing fluid is to urge the latch assembly 225 and wireline 230 downwards in the wellbore 100 as the fluid acts against the shape of latch transfer cup 245 (which is essentially a transport assembly) annularly disposed on the latch assembly 225. The latch assembly is also equipped with latch members 250 constructed and arranged to mate with latch recess 220 formed in an interior of the tool 200. In one embodiment, fluid flow adequate to move the latch assembly downwards is 5-10 barrels of fluid per minute.

Figure 2:
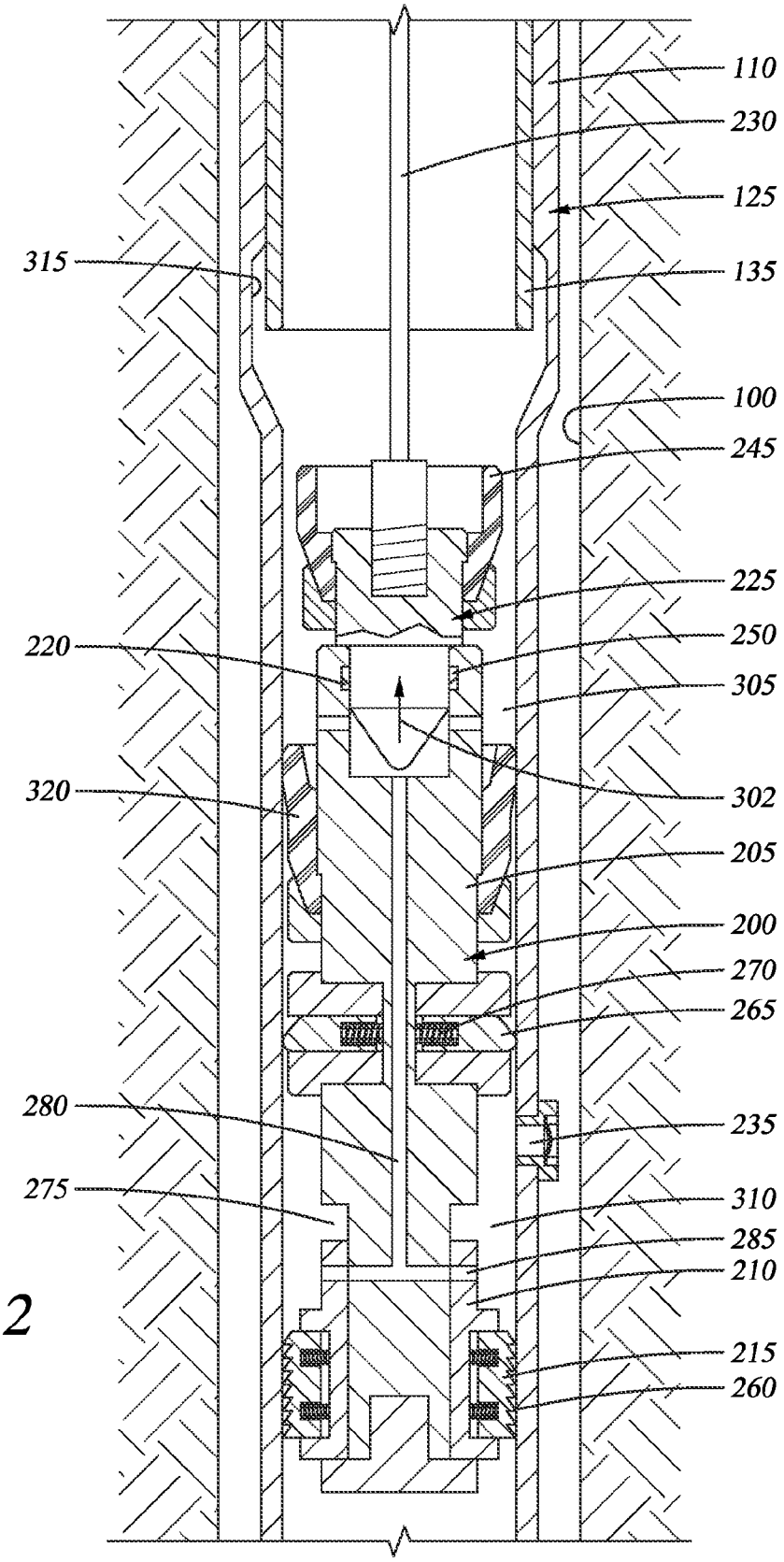
FIG. 2 is a section view of the wellbore of FIG. 1, showing the latch assembly on wireline latched to the fracturing tool.

FIG. 2 is an enlarged section view of the wellbore 100 showing the latch assembly 225 connected to the tool 200. As illustrated (FIG. 1), downwardly flowing fluid has acted upon the latch transfer cup 245 and the assembly has been "pumped down" to the tool. In FIG. 2, latch members 250 of the assembly are housed in the latch recess 220 of the tool 200. FIG. 2 also illustrates additional features of the tool, including upper body portion 205 which is suspended at a lower end of the latch assembly 225. Lower body portion 210 is anchored to an inner wall of the tubular string 110 with anchor assembly 215 having spring-loaded anchors that permit upward movement but prevent downward movement of the tool 200 due to the geometry of its their teeth 260. Upper body portion is also equipped with manipulators in the form of outwardly biased, spring-loaded fingers 265 that are biased against an inner wall of the tubular 110 and serve to shift sleeves 135, thereby establishing a fluid path between an interior and exterior of the wellbore, as will be discussed herein. Each finger 265 is biased with a spring 270.

In FIG. 2, arrow 302 illustrates upward movement of the tool 200 and latch assembly 225 due to an upward force applied to the wireline 230 from the surface of the well. In this disclosure, the term "wireline" is meant to include cable-like material having the strength to support the weight of the tool and any resistance applied to it in order to operate downhole shifting mechanisms, as will be described herein. In one embodiment, the wireline does not include electrical conductors.

The tool 200 is arranged wherein when upward movement is applied, the upper and lower bodies 205, 210 separate to create a gap 275. In doing so, an equalization path 280 formed in the upper body 205 is aligned with equalization ports 285 in the lower body 210, and pressure between an upper 305 and lower 310 annulus is equalized. In this manner, the tool can more easily be moved upwards in a string in order to treat different zones. In one embodiment, the upper and lower bodies 205, 210 are spring-biased apart to ensure their separation in case the anchor 215 does not provide enough "drag" on the lower body. Typically, after latch assembly 225 is connected to the tool 200, the additional packers 150 are set, thereby isolating the subs from each other.

Figure 3:
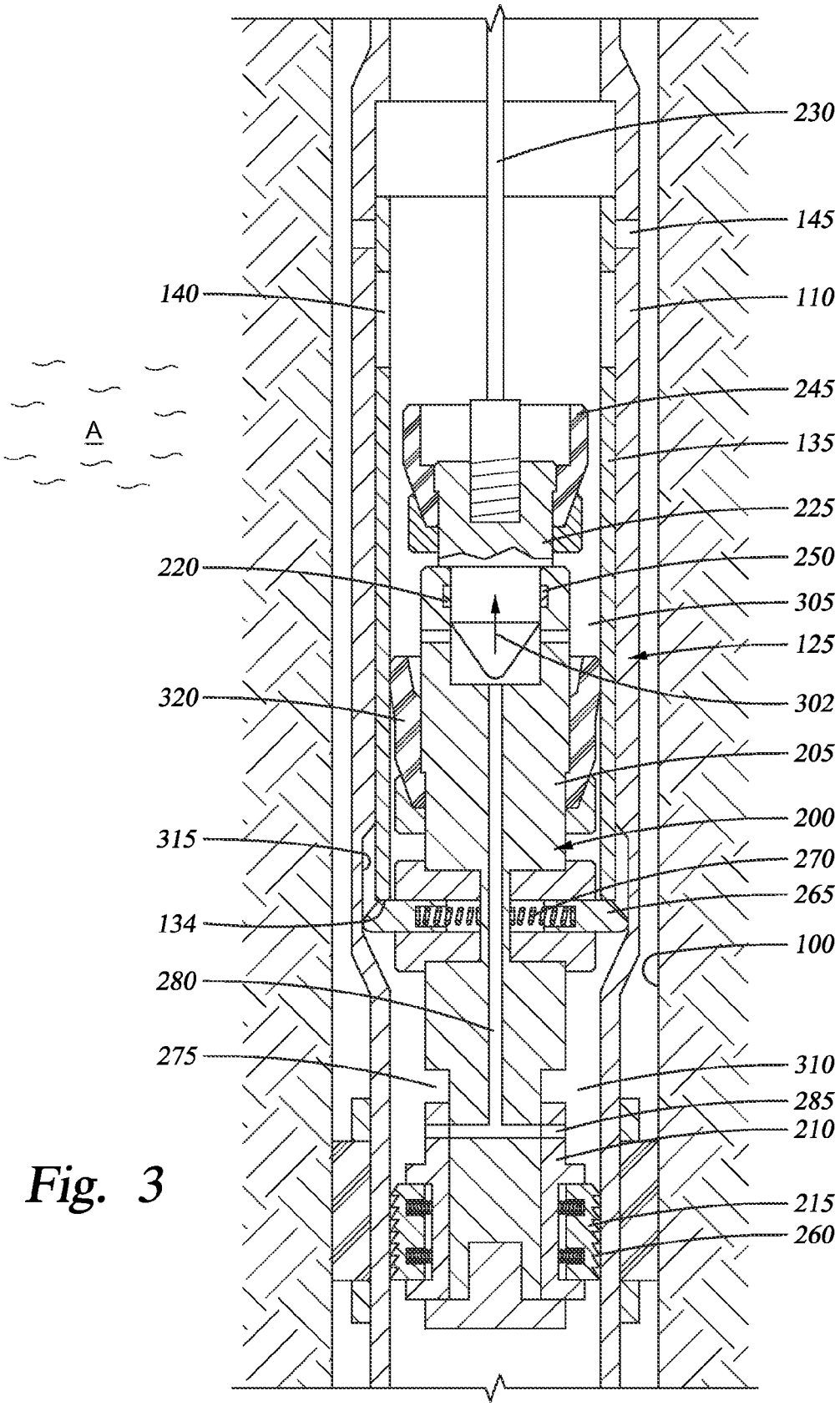
FIG. 3 is a section view of the wellbore of FIG. 2, showing the latch assembly/tool moving upwards in the string to a position in which a spring-loaded finger is adjacent a lower portion of a finger recess formed in a sub and in contact with a lower edge of a sliding sleeve.

FIG. 3 is similar to FIG. 2, with the tool 200 being urged upwards in the string 110 as shown by arrow 301 and the upper and lower body portions 205, 210 of the tool separated in order to align the equalization path 280 and ports 285. In FIG. 3, the tool 200 has been moved upwards in the string 110 to a location adjacent sub 125 and the fingers 265 have partially entered a finger recess 315 formed in the inner diameter of the sub 125. The finger recess 315 is designed to facilitate the shifting of sleeves 135 at each sub 125, 130 (FIG. 1) in order to expose one or more ports 145 leading from the wellbore to an adjacent zone, in this case lower zone A. In FIG. 3, the fingers 265 have also contacted a lower edge 134 of the sleeve 135 and are poised to move the sleeve upwards to a position wherein window 140 formed in the sleeve and port 145 in the body of the sub are aligned. Because the tool 200 is still being moved upwards, the equalization path remains open between upper 305 and lower 310 annular areas.

Figure 4:
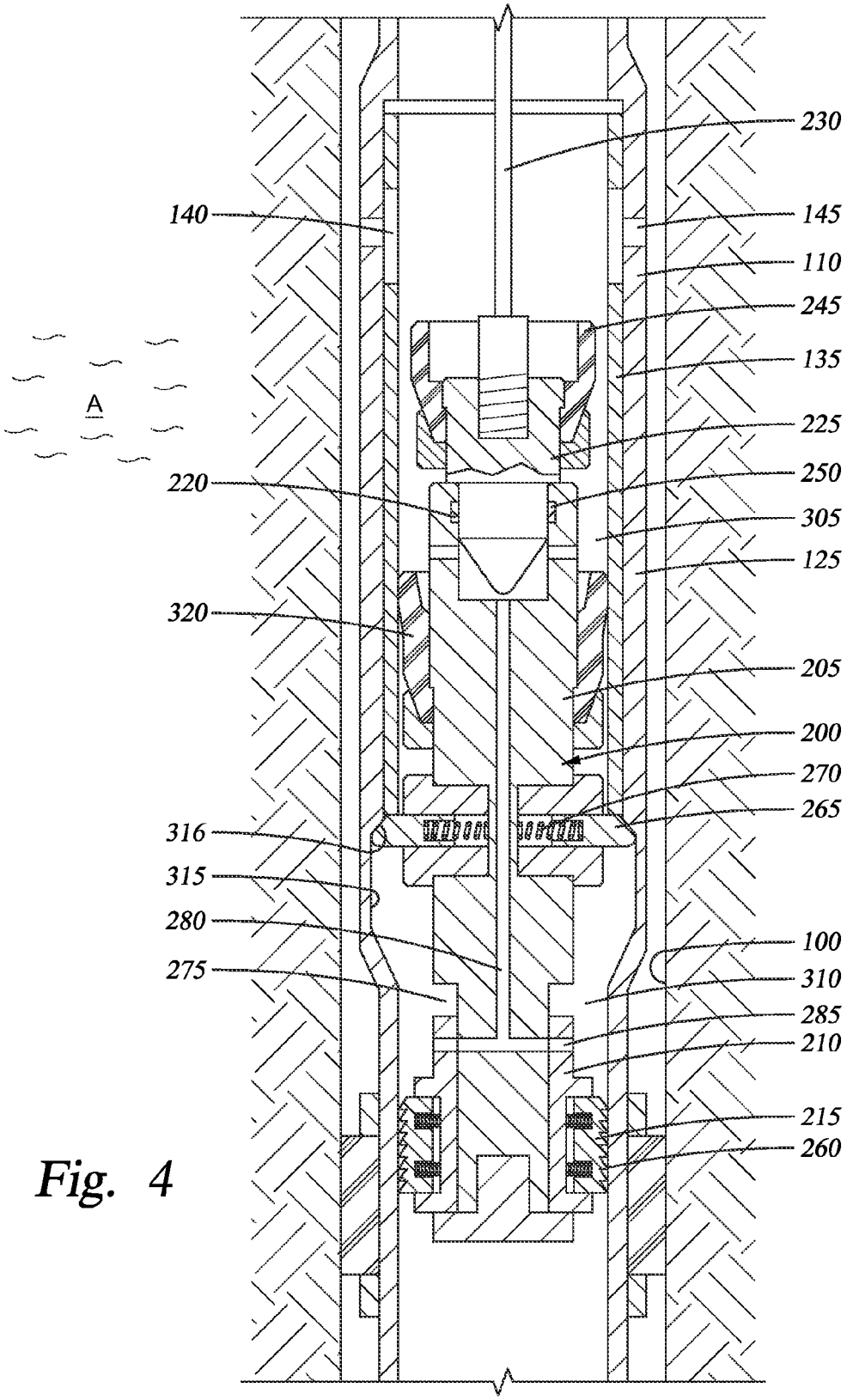
FIG. 4 is a section view showing the spring-loaded finger in a position adjacent an upper portion of the finger recess and showing the sliding sleeve having been moved upward to a location wherein a window of the sleeve is aligned with a port in a wall of the sub.

FIG. 4 illustrates a position wherein the tool 200 has moved upwards to a location in lower sub 125 wherein the fingers 265 have contacted an upper edge 316 of the recess 315. In this position, the sleeve window 140 is fully aligned with the port 145, and upward movement of the tool is halted. In addition, the contact between the finger 165 and the upper edge 316 of the recess creates a resistance with a corresponding resistance in the wireline 230 noticeable by an operator at the surface of the well.

Figure 5:
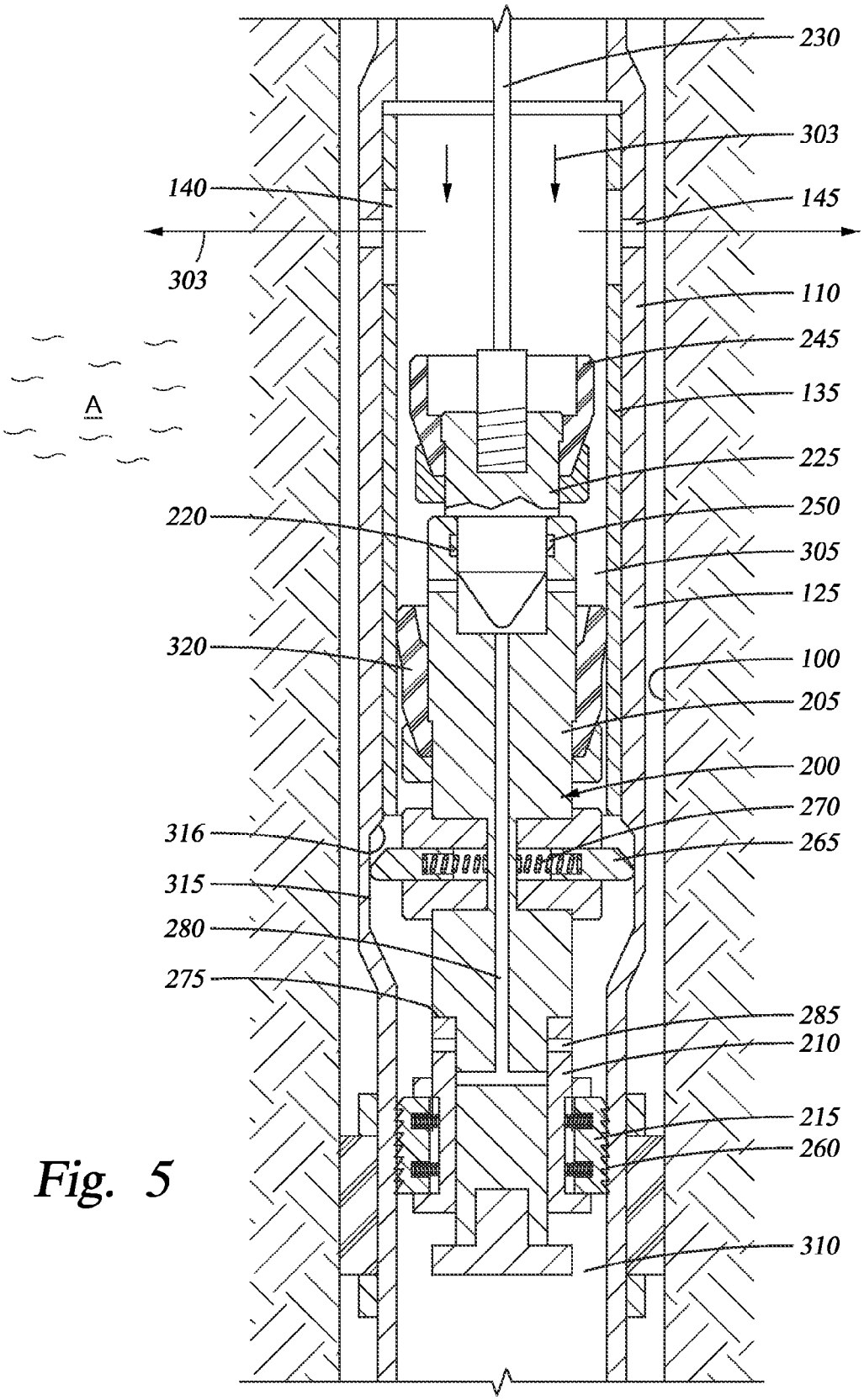
FIG. 5 is a section view of the wellbore, illustrating a fracturing job in progress.

FIG. 5 shows the tool 200 of FIG. 4 after upward force from the wireline 230 has ceased. The absence of upward force has permitted the upper 205 portion of the body to move downwards slightly (note position of fingers 265 relative to recess 315), thereby closing the gap 275 and misaligning the equalization path 280 and ports 285. In this position the closed path 280, in conjunction with a body cup seal 320 annularly disposed about the body of the tool 200, essentially seal the wellbore below the tool. The body cup seal 320 is typically constructed of a stiff but resilient material and its shape ensures that its walls will expand against an inner diameter of the sub, thereby sealing the interior of the sub to the flow of fluid. As shown by arrows 303, fracturing material can now be pumped from the surface of the well at high pressure in order to flow into zone A through the window 140 in sleeve 135 and through the port 145.

Figure 6:
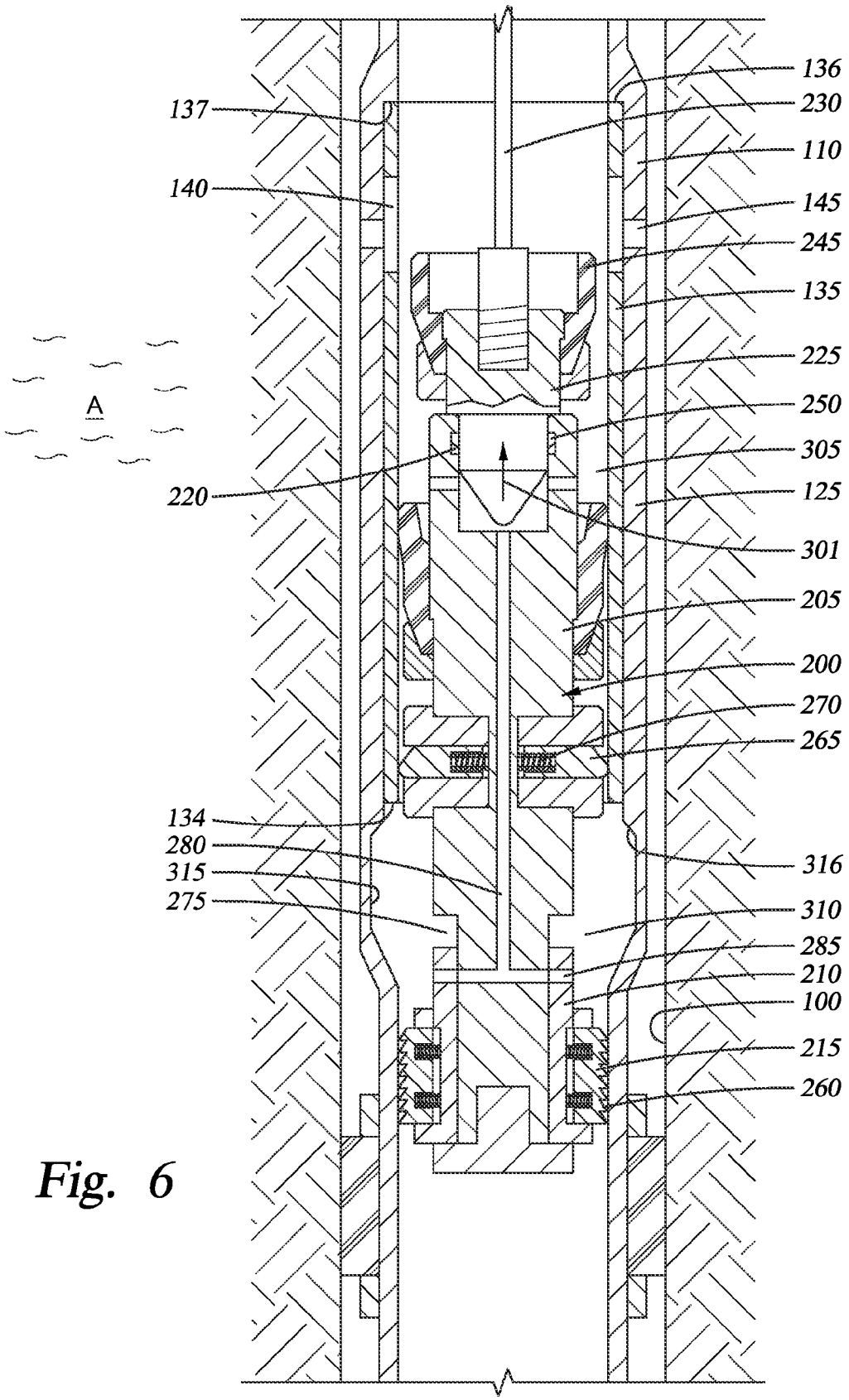
FIG. 6 is a section view of the wellbore, wherein the latch assembly/tool is shown moving upwards towards another sub.

FIG. 6 shows the tool of FIG. 5 after the fracturing job is completed. In this Figure the tool 200 is again being raised as is evident by upward arrow 301 and the location of the fingers 265 relative to the recess 315. As shown, the fingers have moved upward past an upper edge 316 of the recess 315 and past the lower edge 134 of sleeve 135. More specifically, the fingers 265 have depressed springs 270 to a point where the fingers have cleared the lower edge 134 of the sleeve 135. An upper edge of the sleeve 136, as shown in the Figure, has contacted a downwardly facing shoulder 137 formed in the interior of the sub and further upward movement of the sleeve 135 is prevented. In this manner, the tool 200 can continue its upward movement in the string until it reaches sleeve 135 of sub 130 (see FIG. 1). In the meantime, window 135 and port 145 of sub 125 stay aligned and will provide a path to gather hydrocarbons as the well produces.

In one example, the invention is used as follows: The tool 200 is run into a wellbore 100 at the lower end of a string 110 of production tubing. Installed in the string are one or more subs 125, 130, each of which includes a sleeve 135, window 140 and port 145 as has been disclosed herein. The one or more subs are installed in the string in a manner that places them adjacent corresponding zones of interest A, B. Initially, the ports 145 in each sub are in a "closed" position. At some point after the string 110 and tool 200 are run into the wellbore 100, a latch assembly 225 is "pumped down" to a location where it latches with the tool 200. In one embodiment, the latch assembly runs in on wireline 230, as has been described. In another embodiment, it is run into the wellbore on coiled tubing (not shown) or another relatively ridged means.

Once the latch assembly 225 and tool 200 are mated, the tool is pulled upwards in the wellbore with an equalization path 280, 285 through the tool opened. As it moves upwards, spring-loaded fingers 265 encounter the lower end 134 of a sleeve and urge it upwards to a point wherein a window 140 formed in the sleeve 135 aligns itself with an adjacent port 145 formed in an outer wall of the sub. In one embodiment, a recess 135 is formed in an interior wall of the sub to facilitate the manipulation of the sleeve by the fingers 265. Once the window and port are aligned and an upper and lower annular areas 305, 310 above and below the tool are isolated from one another, a fracturing job is performed. Thereafter, the tool 200 is pulled upward to the next tool. The process can be repeated for each zone of interest.

While the foregoing is directed to embodiments of the present invention, other and further embodiments of the invention may be devised without departing from the basic scope thereof, and the scope thereof is determined by the claims that follow.

The invention claimed is:

1. A downhole tool for treating a zone adjacent a wellbore, comprising:

a body, the body having at least two separable portions, the portions operable to open and close a first fluid path through each of the at least two separable portions; and at least one manipulator constructed and arranged to establish a second fluid path between an interior and exterior of the wellbore, wherein the at least one manipulator establishes fluid communication between the interior and exterior of the wellbore while the first fluid path is open through the at least two separable portions.

2. The tool of claim 1, wherein the tool is installable into the inner diameter of a tubular string in a wellbore.

3. The tool of claim 2, wherein the at least one manipulator comprises spring-loaded fingers radially spaced around the tool.

4. The tool of claim 3, wherein the second fluid path is established through the movement of a sleeve to align a port with a window formed in the sleeve.

5. The tool of claim 4, wherein the sleeve, window and port are located in a sub, the sub forming a part of the tubular string at a location adjacent a zone of interest.

6. The tool of claim 5, further comprising a seal for sealing an annular area between the tool and a tubular therearound.

7. The tool of claim 6, wherein the seal is a body cup seal disposed on the tool.

8. The tool of claim 7, further comprising an anchor for limiting movement of the tool in at least one direction.

9. The tool of claim 8, further including a latch recess for downhole connection to a latch.

10. A method of treating a zone adjacent a wellbore, comprising:

providing a tool in a tubular string, the tool including a body having at least two separable portions, the portions operable to open and close a first fluid path through each of the at least two separable portions; and at least one manipulator constructed and arranged to establish a second fluid path between an interior and exterior of the wellbore;

connecting the tool to a wireline extending from the surface of the well;

pulling the tool upwards in the string until the manipulator opens at least one port between the wellbore and a zone while the first fluid path is open through the at least two separable portions; and fracturing the zone through the at least one port.

11. The method of claim 10, further comprising sealing the fluid path through each of the at least two separable portions.

12. The method of claim 11, further comprising sealing an annular area between the tool and the tubular string therearound.

13. The method of claim 12, wherein the at least one port is formed in a sub and is opened by moving a sleeve to align a window of the sleeve with the at least one port.

14. The method of claim 10, wherein a second zone is fractured.

15. The method of claim 14, wherein an annular area in the wellbore adjacent the zone and an area adjacent the second zone are separated by at least one packer.

16. A fracturing assembly for use in a wellbore, comprising:

a body having at least two separable portions, the portions operable to open and close a fluid path through each of the at least two separable portions, disposed in a tubular string and having at least one manipulator, the manipulator constructed and arranged to establish fluid communication between an interior and an exterior of the wellbore;

a transport assembly for moving the body upwards in the tubular string; and at least one sub disposed in the tubular string above the body, the at least one sub including a shiftable sleeve, shiftable by the manipulator to permit the fluid communication, wherein the manipulator establishes fluid communication between the interior and exterior of the wellbore while the fluid path is open through the at least two separable portions.

17. The fracturing assembly of claim 16, wherein the manipulator is disposed in an upper portion of the at least two separable portions.

18. The fracturing assembly of claim 16, wherein the fluid path equalizes pressure in an annulus between the at least two separable portions with pressure in an upper annulus.

19. The fracturing assembly of claim 16, wherein the transport assembly is operable to open and close the fluid path through each of the at least two separable portions.

20. A method of treating a zone adjacent a wellbore, comprising:

deploying a tubular string having a fracturing assembly installed in the tubular string into the wellbore before deployment, the fracturing assembly comprising:

a body, comprising a first fluid path through the body, wherein the first fluid path is closed while deploying the tubular string with the fracturing assembly; and at least one sub disposed in the tubular string above the body, the at least one sub comprising a second fluid path between an interior and exterior of the wellbore, wherein the second fluid path is closed while deploying the tubular string with the fracturing assembly; and opening the second fluid path using the body.

21. The method of claim 20, further comprising:

lowering a latch assembly through the wellbore;

engaging the body with the latch assembly; and moving the body through the tubular string using the latch assembly.

22. The method of claim 21, further comprising:

moving the body through the tubular string to a second sub, wherein the second sub comprises a fluid path between an interior and exterior of the wellbore; and opening the fluid path by moving the body through the tubular string.

23. The method of claim 20, further comprising treating the zone through the second fluid path.

24. A method of establishing a fluid path between an interior and exterior of a tubular string, comprising:

lowering a latch assembly through the tubular string;

engaging a fracturing tool with the latch assembly;

moving the fracturing tool and latch assembly towards a sleeve disposed in the tubular string; and moving the sleeve using the fracturing tool thereby establishing a fluid path between the interior and exterior of the tubular string.

* * * * *